United States Patent [19]

Killian

[11] 4,170,980

[45] Oct. 16, 1979

[54] ARCHERY BOW ARROW REST

[76] Inventor: Gerald I. Killian, 16016 SE. 82nd Dr., Clackamas, Oreg. 97015

[21] Appl. No.: 889,979

[22] Filed: Mar. 24, 1978

[51] Int. Cl.[2] ..... F41B 5/00

[52] U.S. Cl. ..... 124/41 A

[58] Field of Search ..... 124/41 A, 24 A, 24 R, 124/35 A, 88, 86

[56] References Cited

U.S. PATENT DOCUMENTS

| | | | |
|---|---|---|---|
| 3,108,584 | 10/1963 | Coe | 124/24 R |
| 3,232,286 | 2/1966 | Gilyton | 124/24 |
| 3,482,563 | 12/1969 | Pint | 124/41 A |
| 3,757,764 | 9/1973 | Ikeya | 124/41 A |
| 3,865,096 | 2/1975 | Troncoso | 124/88 X |
| 3,890,951 | 6/1975 | Jennings et al. | 124/41 A |

*Primary Examiner*—Richard C. Pinkham
*Assistant Examiner*—William R. Browne
*Attorney, Agent, or Firm*—James E. Nilles

[57] ABSTRACT

An archery bow arrow rest includes a hollow cylinder threaded externally for removable attachment in a threaded opening through the handle of an archery bow and threaded internally for removable attachment of a hollow, externally threaded guide sleeve which anchors a support plate and slidably guides a spring-loaded plunger for axial movement on the longitudinal axis of the cylinder. An arrow rest arm is mounted pivotally at one end on the support plate for arcuate movement in a plane disposed below and parallel to the axis of movement of the plunger, and is spring-loaded in a manner to return the arm to an intermediate, arrow supporting position.

5 Claims, 5 Drawing Figures

ARCHERY BOW ARROW REST

BACKGROUND OF THE INVENTION

This invention relates to arrow rests for archery bows, and more particularly to an arrow rest which is capable of pivotal movement in opposite directions from an intermediate, arrow supporting position.

Arrow rests provided heretofore are of two types. One such type of arrow rest is a rod which is rigid in the direction of arrow movement and thus causes excessive deflection of the arrow when contacted by the arrow vanes. The second type of arrow rest provided heretofore is a resilient member which, although it is movable resiliently in the direction of arrow movement, it is subject to breakage or other damage when moved in the opposite direction, as when snagged on brush during movement through wooded areas.

Further, neither of the foregoing two types of arrow rests has been integrated with a resilient side abutment for an arrow in a manner affording adjustment of both components simultaneously in the lateral direction relative to the archery bow.

SUMMARY OF THE INVENTION

In its basic concept, the arrow rest of this invention comprises an arrow support arm which is pivoted for arcuate movement in opposite directions from an intermediate, arrow supporting position and is spring-loaded for return to said intermediate position.

It is by virtue of the foregoing basic concept that the principal objective of this invention is achieved; namely, to overcome the aforementioned disadvantages and limitations of prior archery bow arrow rests.

Another objective of this invention is the provision of an arrow rest of the class described with which is integrated a spring-loaded plunger for resiliently engaging the side of an arrow supported on the arm and resiliently resisting movement of the arrow inwardly toward the archery bow during the initial flight of the arrow, due to buckling of the arrow upon release, the integral assembly being adjustable laterally relative to the archery bow.

A further objective of this invention is the provision of an arrow rest of the class described which is capable of mounting on archery bows of all types.

A still further object of this invention is the provision of an arrow rest of the class described which is of simplified construction for economical manufacture and provides long and faithful operation with minimum maintenance and repair.

The foregoing and other objects and advantages of this invention will appear from the following detailed description taken in connection with the accompanying drawings of a preferred embodiment.

DESCRIPTION OF THE PREFERRED EMBODIMENT

Figure 2:
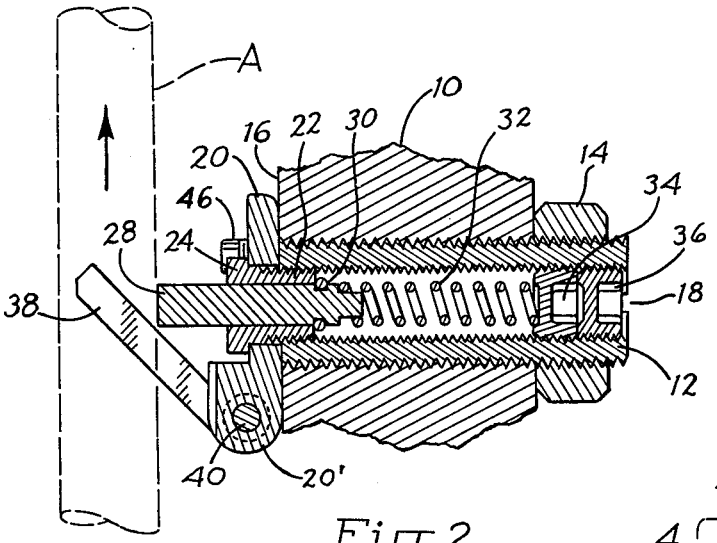
FIG. 2 is a fragmentary sectional view taken on the line 2—2 in FIG. 1.
Figure 5:
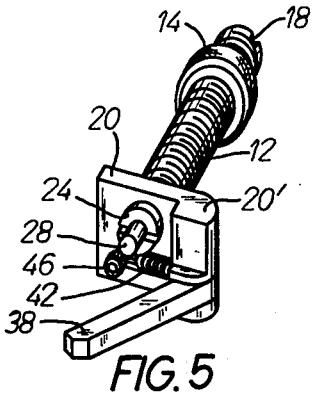
FIG. 5 is a perspective view of the arrow rest shown in the other figures.
Figure 3:
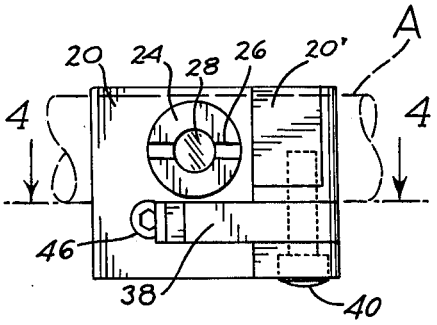
FIG. 3 is a side elevational view of the arrow rest as viewed from the left in FIG. 1.
Figure 1:
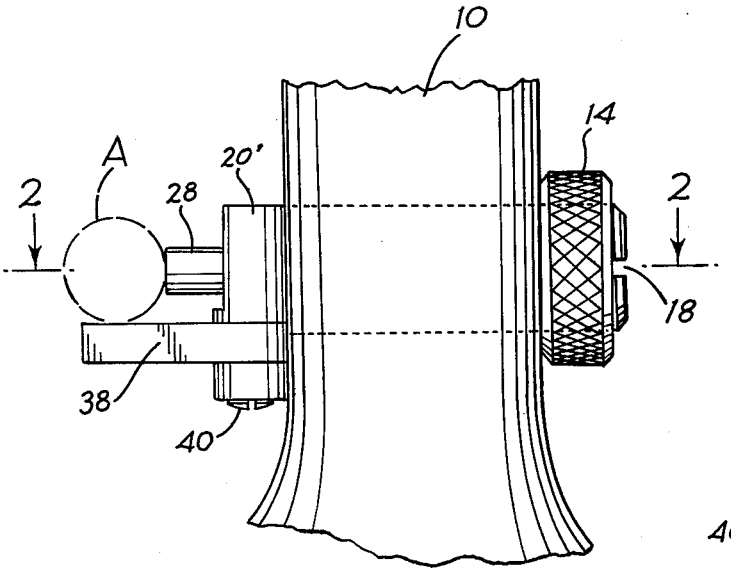
FIG. 1 is a fragmentary vertical elevation of the window portion of an archery bow handle, as viewed from the position of a right handed archer, the bow having incorporated therewith an arrow rest embodying the features of this invention.

As mentioned, FIG. 1 illustrates the window portion of an archery bow handle 10, immediately above the hand grip portion, and it is viewed from the position of a right handed archer during sighting.

As illustrated, the handle is provided with a transverse bore for the reception of a base member in the form of a hollow cylinder 12. Preferably, the cylinder is threaded externally and the bore through the bow handle is correspondingly threaded, to provide a positive connection of the cylinder to the handle. A lock nut 14 is threaded onto the outer projecting end of the cylinder to abut the outer surface of the handle and thus lock the cylinder securely in place. Although the inner end of the cylinder is shown terminating flush with the inner surface 16 of the bow window, it is to be understood that the inner surface of the cylinder may project outward beyond the window surface 16, if desired. This positioning of the cylinder is accommodated by the use of a screw driver fitted into the screw driver slot 18 provided in the outer end of the cylinder.

The arrow rest of this invention includes a support member, illustrated in the form of a plate 20. An opening through the plate freely receives the threaded shank 22 of a clamp screw for threaded engagement with the internal threads of the hollow cylinder. The enlarged head 24 of the clamp screw abuts the outer surface of the support plate 20, whereby the latter is clamped securely between the screw head 24 and the inner end of the cylinder 12. The screw head is provided with a screw driver slot 26.

In the preferred embodiment illustrated, the clamp screw is provided in the form of a hollow guide sleeve the bore of which slidably receives therethrough an elongated plunger 28. A ring 30 seated in an annular groove adjacent the inner end of the plunger provides a stop for abutting the inner end of the sleeve 22 to limit the outward extension of the plunger.

The plunger is spring-loaded in the manner to be urged resiliently outward to its limit of extension. In the embodiment illustrated, the spring-loading is provided by an elongated coil spring 32 one end of which engages the inner end of the plunger and the opposite end of which engages the inner end of an adjustment screw 34 which is threaded into the outer end of the cylinder and is adjustable longitudinally of the cylinder to vary the degree of compression of the spring. A locking screw 36 also is provided in the threaded bore of the cylinder to abut the adjustment screw 34 and thus retain the latter in the desired position of adjustment. Both screws are provided with drive sockets, such as the Allen screw sockets illustrated, for rotating them.

An arrow rest arm 38 is mounted pivotally at one end on a thickened portion 20' of the support member 20, by means of a pivot pin 40 the pivot axis of which extends perpendicular to the direction of movement of the plunger, or parallel to the bow string of the archery bow. The arm 38 thus is mounted for movement arcuately in a plane extending substantially parallel to the axis of reciprocative movement of the plunger 28, i.e. substantially normal to the bow string. The arm extends laterally outward from the inner surface of the bow window, slightly below the plunger, and functions to support an arrow A preliminary to projecting it from the bow.

The spring-loaded plunger 28 serves as a side abutment for an arrow supported upon the arm 38, and functions to provide resilient resistance to movement of the arrow toward the bow as the arrow is projected upon release of the bow string. The degree of resilient resistance provided by the plunger is adjustable by varying the degree of compression of the coil spring 32 by the adjustment screw 34, as described hereinbefore.

In accordance with this invention, the arrow rest arm 38 is mounted pivotally on the support member, by the pivot pin 40, for arcuate movement of the arm in opposite directions from an intermediate, arrow supporting position, and resilient means is provided for returning the arm to said intermediate position. In the embodiment illustrated, a coil spring 42 is secured at one end to the arm adjacent the pivot 40, as by means of an anchor pin 44, and at its opposite end to an anchor screw 46 secured to the support member 20.

Figure 4:
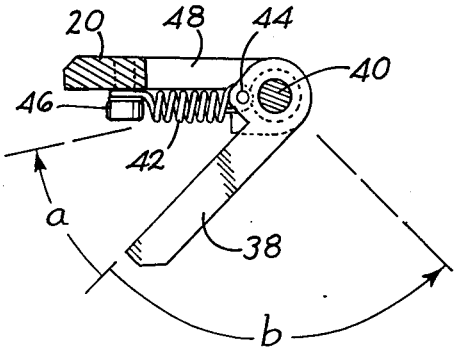
FIG. 4 is a sectional view taken on the line 4—4 in FIG. 3.

As illustrated in FIG. 4 of the drawing, the arm is pivotable forwardly through arc a and rearwardly through arc b from the intermediate, arrow supporting position illustrated, the coil spring 42 serving to return the arm to the intermediate position shown. To accommodate the forward arcuate movement of the arm through the arc a, a portion of the coil spring and an inner portion of the arm moves into a slot 48 provided in the support member 20.

In operation, when an arrow A resting upon the arm 38 is projected from the bow string, the frictional contact between the arrow and arm, as well as the contact between the arm and one of the arrow vanes, causes the arm to pivot arcuately forward. This action minimizes the lateral movement of the arrow and thus contributes to a more stable and accurate trajectory of an arrow to its target.

During transport of the bow, as through a wooded area, any inadvertent contact of the arrow rest arm 38 with an obstacle, such as tree branches, brush and other objects, will result in arcuate movement of the arm in the rearward direction relative to the direction of movement of an arrow. This rearward movement of the arm, against the resistance of the coil spring 42, prevents breakage or other damage of the arm. When the arm has been released from the obstacle, the coil spring 42 urges the arm resiliently forward to its intermediate, arrow supporting position illustrated in the drawing.

Coil springs 42 of varying degrees of tension may be selected to provide the desired degree of resistance to pivotal movement of the arm. In similar manner, the degree of resilient resistance to inward retraction of the plunger 28, by lateral movement of an arrow, may be provided by appropriate selection of springs 32 of different tension as well as by pre-compressing of the spring by means of the adjustment screw 34.

It will be apparent to those skilled in the art that various changes may be made in the size, shape, type, number and arrangement of parts described hereinbelow without departing from the spirit of this invention.

Having now described my invention and the manner in which it may be used, I claim:

1. An arrow rest for an archery bow having a handle and an arrow-projecting bow string, comprising (a) a hollow base member arranged to extend through a lateral opening through an archery bow handle and having an inner end extending from and located adjacent one side of said handle, (b) an arrow rest arm support member secured to the inner end of the base member, (c) an arrow rest arm having an upper arrow supporting surface, (d) pivot means interconnecting the arrow rest arm and support member for arcuate movement of the arm in a plane laterally outward from the base member and support member, (e) resilient means interengaging the support member and arm for urging the arm resiliently to a laterally extending, arrow supporting position away from said side of said handle and intermediate the limits of pivotal movement of the arm, (f) an arrow side support plunger member resiliently mounted in the hollow base member and extending resiliently outward through an opening in the support member above the arrow rest arm for reciprocative movement on a line disposed parallel to said plane of arcuate movement of the arm, said pivot means remaining stationary with respect to the base member regardless of the position of said arrow side support plunger member, and (g) attaching means for securing the base member to an archery bow handle with said plane of arcuate movement of the arrow rest arm disposed perpendicular to the longitudinal dimension of the bow string, and said plane extending substantially parallel to said arrow support upper surface of said arrow rest arm.

2. The arrow rest of claim 1 wherein the base member is a hollow cylinder having a threaded outer circumference for adjustable reception in a threaded transverse bore through an archery bow handle, for adjusting the position of the inner end of the cylinder relative to said one side of the archery bow handle.

3. The arrow rest of claim 1 wherein the support member has a slot therein freely receiving the pivoted end of the arrow rest arm, and the resilient means comprises an axially elongated coil spring secured at one end to the arm adjacent the pivot means and secured at the opposite end to the support member, the spring being located for registry with the slot in the support member.

4. The arrow rest of claim 1 including a hollow clamp screw secured removably to the inner end of the base member and having an enlarged outer head, the screw extending through an opening in the support member for clamping the support member between the inner end of the base member and the enlarged head of the screw, the hollow clamp screw receiving the plunger member slidably therethrough for guiding the plunger member in its reciprocative movement.

5. The arrow rest of claim 4 including (a) stop means on the plunger member arranged to engage the clamp screw to limit outward extension of the plunger member, (b) a coil spring in the hollow base member engaging the plunger member at one end, and (c) a spring abutment member secured in the end of the base member opposite the clamp screw for longitudinal adjustment relative thereto for varying the degree of compression of the coil spring.

* * * * *